United States Patent [19]

Reymann et al.

[11] Patent Number: 4,789,010

[45] Date of Patent: Dec. 6, 1988

[54] APPARATUS FOR MANUFACTURING REINFORCEMENTS

[75] Inventors: Wolfgang Reymann, Karletweg 7, D-6832 Hockenheim; Wilhelm Orth, Brunnenweg 1, D-6747 Annweiler-Bindersbach, both of Fed. Rep. of Germany

[73] Assignees: Manfred Lösch, Germersheim; Wolfgang Reymann, Hockenheim, both of Fed. Rep. of Germany

[21] Appl. No.: 46,897

[22] Filed: May 7, 1987

[30] Foreign Application Priority Data

May 7, 1986 [DE] Fed. Rep. of Germany ..... 3615460

[51] Int. Cl.[4] ..... B21F 15/00

[52] U.S. Cl. ..... 140/111; 29/783; 425/123

[58] Field of Search ..... 140/111, 112; 425/123, 425/126 R; 264/275, 277; 29/783, 784, 786, 791, 793, 460

[56] References Cited

U.S. PATENT DOCUMENTS

| | | | |
|---|---|---|---|
| 3,530,634 | 9/1970 | Adams | 425/123 |
| 3,555,131 | 1/1971 | Weismann | 425/123 |
| 4,098,562 | 7/1978 | Levin | 425/123 |

FOREIGN PATENT DOCUMENTS

| | | |
|---|---|---|
| 1269557 | 5/1968 | Fed. Rep. of Germany . |
| 90088 | 5/1972 | Fed. Rep. of Germany . |
| 2618879 | 11/1977 | Fed. Rep. of Germany . |

*Primary Examiner*—Lowell A. Larson

*Attorney, Agent, or Firm*—Spencer & Frank

[57] ABSTRACT

The invention relates to an apparatus for producing reinforcements, intended for construction purposes, of reinforced concrete plates for prefabricated ceilings, without manual aid. The apparatus comprises a straightening and cutting device 1 for the transverse rods 22 of the reinforcement having a transverse rod outlet path 4, a displacement apparatus 46 and a transverse rod magazine 7; a straightening, cutting and bending device 2 for the longitudinal rods 23 having a longitudinal rod outlet path 5; and a combination device 3 for producing the lattice girders 24, having a lattice girder outlet path 6 and a lattice girder magazine 8. With the aid of the transverse rod magazine 7 and two insertion robots 9 and 10 that are displaceable on rails 67, the reinforcement can be inserted and positioned under electronic control into the form 18 that is arranged on a pallet 15 and is moved through the apparatus on a travel path 13. A slip-on device 29 serving to slip spacers 30 onto the transverse rods 22 is disposed between the straightening and cutting device 1 and the transverse rod outlet path 4. The entire reinforcement is made from round wires and bands of structural steel wound into rings.

15 Claims, 3 Drawing Sheets

APPARATUS FOR MANUFACTURING REINFORCEMENTS

Figure 1:
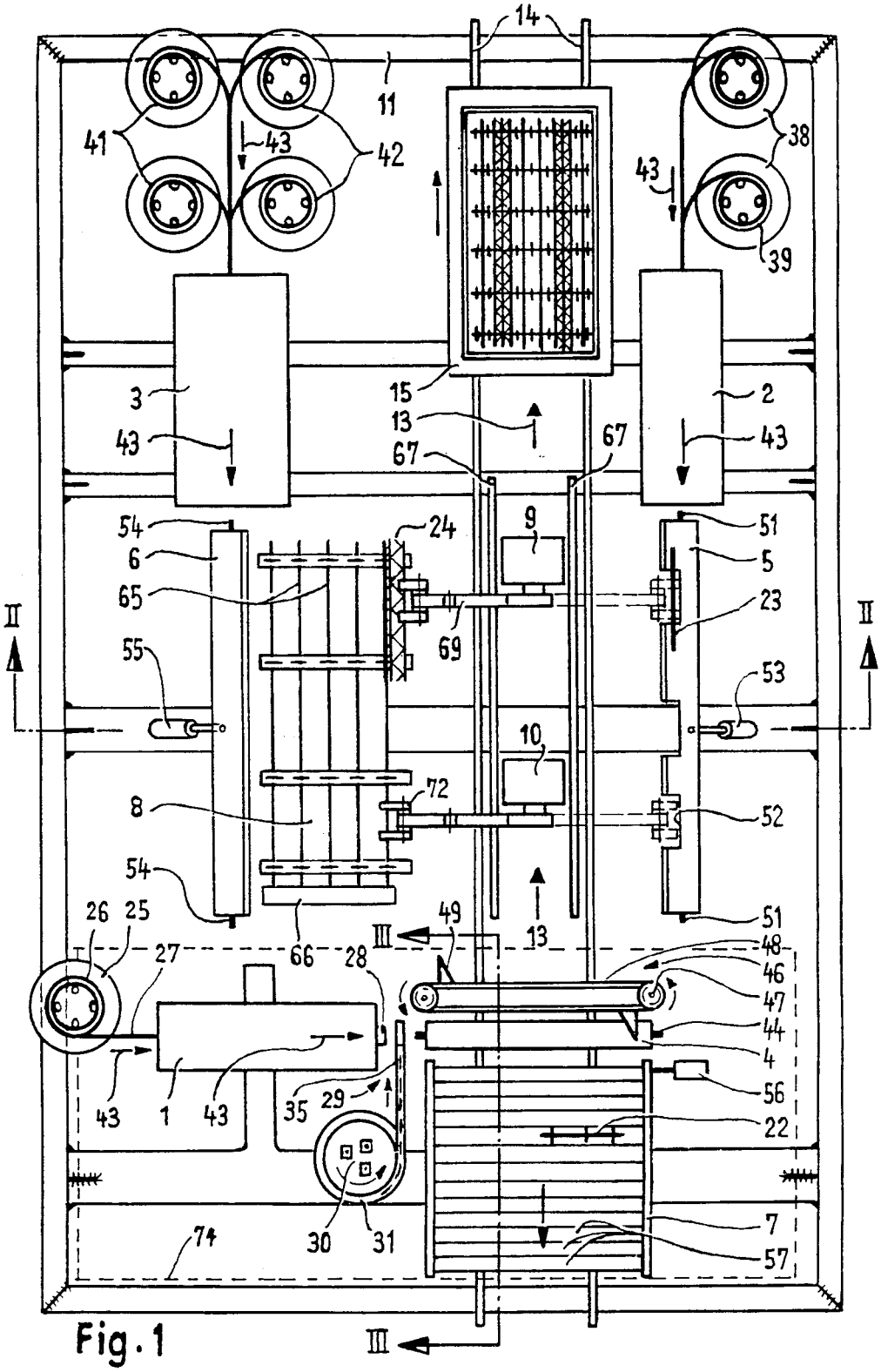

The innovation relates to an apparatus for producing reinforcements, intended for construction purposes, of reinforced concrete plates for prefabricated ceilings, using forms, serving to receive the reinforcements as well as the poured concrete, that can be set up on pallets that are movable along a travel path, having a straightening and cutting device for preparing the transverse rods, a straightening, cutting and bending device for the longitudinal rods, and a combination device for preparing the lattice girder, which have outlet paths for the transverse rods, longitudinal rods and lattice girders and are supplied with round wires and bands of structural steel, wound into rings.

The innovation is applicable to the industrial production of prefabricated ceilings of various dimensions, for buildings of any kind.

In the production of reinforced concrete plates for prefabricated ceilings, first the forms into which the concrete is to be poured are arranged by size and shape on movable pallets and then the necessary reinforcement is inserted in them by hand. This reinforcement comprises a number of transverse and longitudinal rods, the number depending on static requirements, and several lattice girders, which are placed upon the pallet in a predetermined arrangement and at predetermined points with reference to drawings or markings.

It is known to make the individual parts of the reinforcement—not only the transverse and longitudinal rods, but the lattice girders as well—by machine, automatically, from rings of round wires or bands of structural steel by means of electronically controlled devices, in which the wires and bands are straightened, cut into lengths, bent and welded. Typically, the finished parts, deposited by these devices on outlet paths, are then stored and later transported to the point at which they are inserted—by hand, or at most with the aid of a crane—in the form on the pallet, after spacers have been set—once again, by hand—on the transverse rods that are to be inserted first.

The object of the invention resides in the conception of an apparatus with the aid of which the the entire reinforcement of reinforced steel plates for prefabricated ceilings of varying size can be inserted and emplaced in the forms without manual aid.

To attain this object, an apparatus of the aforementioned type is used as a basis, which is equipped with a straightening and cutting device for the transverse rods, a straightening, cutting and bending device for the longitudinal rods and a combination device for the lattice girders, which have outlet paths for the transverse rods, longitudinal rods and lattice girders and are supplied with round wires and bands of structural steel, wound into rings. The stated object is attained in that the transverse rod outlet path is located above and at right angles to the travel path, that the longitudinal rod outlet path and the lattice girder outlet path are located opposite each other and parallel to, on opposite sides of and above the travel path, that a lattice girder magazine is provided between the lattice girder outlet path and the travel path, and that two insertion robots are disposed between the lattice girder magazine and the longitudinal rod outlet path. With this apparatus, it is possible for the entire reinforcement of reinforced concrete plates for prefabricated ceilings to be inserted automatically into the forms and positioned there. The proposed apparatus not only saves heavy manual labor but also saves working time and avoids incorrect filling. Less structural steel is also needed, because machine positioning precludes faulty reinforcements. The innovation furthermore offers an unexpected advantage, in that it enables a kind of reinforcement that meets static requirements and until now was impossible, because of possible mistakes or virtually insupportable costs.

In an advantageous feature of the innovation, a displacement device for the transverse rods is provided on the transverse rod outlet path. This displacement device permits transverse rods of an abritrary length to be deposited at the point intended for them in the form.

Suitably, the transverse rod outlet path, the longitudinal rod outlet path and the lattice girder outlet path are disposed such that they are tiltable crosswise to their longitudinal direction. This arrangement makes it simple to transfer the finished transverse and longitudinal rods as well as the finished lattice girders to following devices. or to pre-position them in a defined way for such devices.

A mechanically actuated tilting device is capable of engaging the outlet paths for the transverse and longitudinal rod and for the lattice girders. This kind of tilting device is easily controlled electronically, so that the instant of transfer to the following devices can be designated without difficulty.

As a further feature of the proposed apparatus, a transverse rod magazine is mounted laterally on the transverse rod outlet path. This transverse rod magazine serves as temporary storage for the finished transverse rods that are already equipped with spacers.

Advantageously serving as the transverse rod magazine is a conveyor apparatus that has shelves for receiving the transverse rods that have been provided with the spacers. With this conveyor apparatus, the transverse rods can be taken from the transverse rod outlet path and placed upon the pallet.

In between the straightening and cutting device for the transverse rods and the outlet path for the transverse rods, a slip-on apparatus for spacers is advantageously provided. With this slip-on apparatus, the transverse rods can be equipped with the required number of spacers while the transverse rods are being ejected from the straightening and cutting device.

The slip-on apparatus suitably has a mechanically actuated ram and is connected to a shaker conveyor. The shaker conveyor, serving as a magazine for the spacers, advances the spacers to their intended position below the ram, with the aid of which they are slipped onto the transverse rods.

In the proposed apparatus, the straightening, cutting and bending device for the longitudinal rods, along with its longitudinal rod outlet path, and the combination device for the lattice girders, along with its lattice girder outlet path, are advantageously mounted above the travel path. Not only does this provision save space, but it also makes it easier to service the apparatus and to insert the reinforcement into the form that travels past underneath it, resting on the pallet.

The two insertion robots are suitably provided above the travel path. At this location, these devices have the greatest freedom of action and should some disruption occur, a shift to manual insertion can be made without hindrance and without delay.

The two insertion robots will suitably have pivoting arms, which are movable in planes at right angles to the travel path.

At the free end of the pivoting arms of the insertion robots, tong-like double grippers are mounted. These double grippers enable reliable grasping and insertion, even of short longitudinal rods or lattice girders.

It is particularly advantageous if the two insertion robots are disposed so that they are displaceable in the longitudinal direction of the travel path. This enables guiding the two insertion robots in such a way that they can insert the sometimes very long longitudinal wires and lattice beams into the mold without disruption.

It is suitable for the lattice girder magazine to have mechanically actuated pawls. With the aid of these pawls, and with the lattice girder magazine inclined, the finished lattice girders at the end of the magazine can easily be made to slide downward.

It may be advantageous for the straightening and cutting device for the transverse rods, the slip-on device for the spacers, the transverse rod outlet path, the displacement device and the transverse rod magazine to be disposed together on a frame, and with its aid, using a suitable drive means, to be displaceable in common in the frame, parallel to the travel path. The direction of the displacement can be selected and the displacement speed can be matched to that of the trolley of the pallet, which facilitates depositing the transverse rods in the form.

Figure 2:
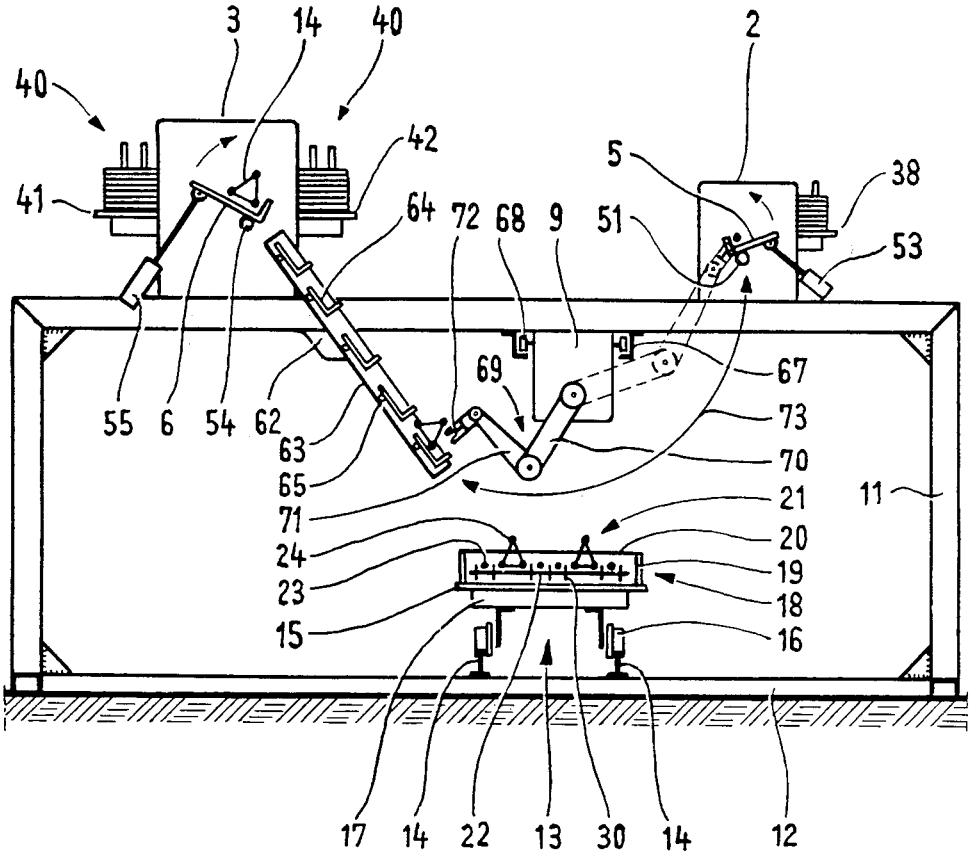
Figure 3:
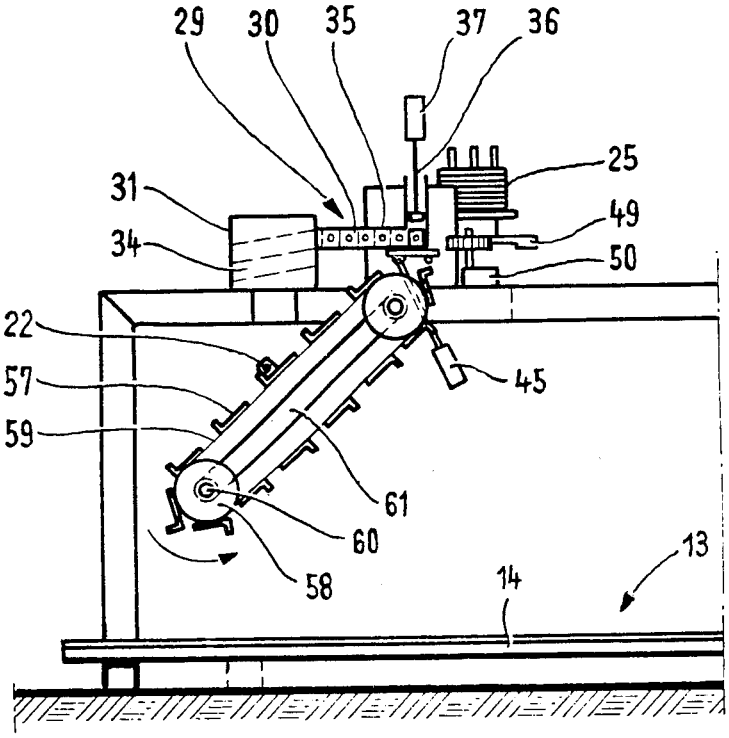
Figure 4:
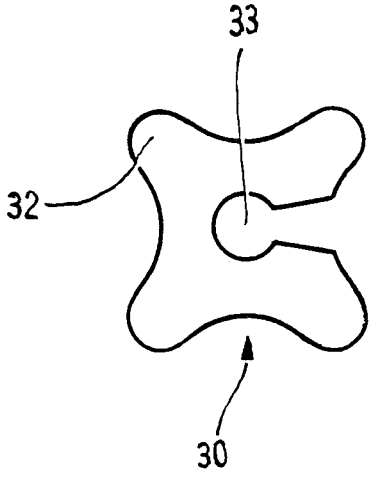

The proposed apparatus will be described in further detail below in terms of an exemplary embodiment, referring to the accompanying drawings. Shown in simplified form in these drawings are:

FIG. 1, the apparatus in a plan view;

FIG. 2, the apparatus of FIG. 1, in a vertical section taken along the line II—II of FIG. 1;

FIG. 3, the front portion of the apparatus of FIG. 1, again in a vertical section, taken along the line III—III of FIG. 3; and FIG. 4, a spacer, seen in plan view.

The apparatus for producing reinforcements of reinforced concrete plates for prefabricated ceilings intended for construction purposes—see FIG. 1—substantially comprises a straightening and cutting device 1 for preparing the transverse rods, a straightening, cutting and bending device 2 for the longitudinal rods, a combination device 3 for the lattice girders, a transverse rod outlet path 4, a longitudinal rod outlet path 5, a lattice girder outlet path 6, a transverse rod magazine 7, a lattice girder magazine 8, and two insertion robots 9 and 10. All these components of the apparatus are disposed in an elongated rectangular frame 11 made of U-profile rails.

Disposed on the bottom parts 12 of the frame 11 is a travel path 13—see FIG. 2—in the form of a track comprising two parallel rails 14, on which a pallet 15 is movable and to this end has four wheels 16. A form 18 into which concrete is to be poured, made from joining two longitudinal walls 19 and two end walls 20, is arranged on the pallet, which can be picked up from a trolley 17. The reinforcement 21 that is produced by means of the apparatus rests in this form 18 and is assembled from transverse rods 22, longitudinal rods 23 and lattice girders 24, which are all made of structural steel.

The straightening and cutting device 1 for preparing the transverse rods 22 is attached beside and above the travel path 13 on the frame 11, at right angles to the travel path 13. Preceding the straightening and cutting device 1 is a rotatable unwinding reel 25, on which a ring 26 of a round wire having a diameter of 5 to 12 mm is mounted. The round wire 27, the beginning of which is threaded into the straightening and cutting device 1, is drawn continuously into the straightening and cutting device 1, in which it is straightened and cut successively into segments having a specific predetermined length, which are ejected at the outlet 28 to the device. In terms of its construction and mode of operation, this straightening and cutting device 1 is known and accordingly needs no further description.

Between the straightening and cutting device 1 for the transverse rods 22 and the transverse rod outlet path 4, a slip-on apparatus 29 for spacers 30 is provided. The disk-like spacers 30 (see FIG. 3), which are made of a suitable plastic, are located in a shaker conveyor 31 and have a substantially square outline with four protruding corners and a central opening 33, the diameter of which is somewhat less than that of the round wire 27 of the transverse rod 22, the central opening 33 merging with a slit that tapers inward slightly. The spacers 30 move from the shaker conveyor 31, which is provided with a spiral path 34, into a horizontal trough 35, the end of which is located before the outlet 28 of the device. A vertically movable ram 36, which is actuated mechanically by an actuating device 37, pushes one spacer 30 at a time onto the transverse rods 22 at predetermined time intervals, while these rods are being ejected from the straightening and cutting device 1 and being deposited onto the adjoining transverse rod outlet path 4.

The straightening, cutting and bending device 2 for the longitudinal rods 23 is likewise disposed beside and above the travel path 13 and its operating direction is parallel to the travel path 13; its mode o operation and its function are known and so need no further explanation. At the beginning of this straightening, cutting and bending device 2, two (or more) rotatable unwinding reels 38 are provided, on which rings 39 of a round wire of from 5 to 12 mm are mounted; this wire is straightened, cut into lengths and also, as needed, bent at its ends.

The combination device 3 for furnishing the lattice girders 24 is again a known apparatus, available on the market, which is disposed behind and above as well as parallel to the travel path 13 on the frame 11. Located at the beginning of this combination device 3 are four unwinding reels 40, on which rings 41 of round wires and rings 42 of structural steel bands are located. In the combination device 3, the round wires and the bands are straightened, bent, cut off and welded together to make lattice girders 24, which finally, in the finished state, are ejected.

The arrows 43 indicate the operating direction of the straightening and cutting device 1, the straightening, cutting and bending device 3 and the combination device 3.

The transverse rod outlet path 4, which is mounted on the straightening and cutting device 1 for the transverse rods 22 following the slip-on device 29 for the spacers 30, as seen in the operating direction, is located above the travel path 13 and is disposed at right angles to it—see FIGS. 1 and 2. This transverse rod outlet path 4 comprises a flat, long and narrow table, which on its ends has two eccentrically arranged pivot pins 44, about which the transverse rod outlet path 4 can be tilted transverse to its longitudinal direction. The transverse rod outlet path 4 is engaged by a controlled, mechanically actuated tilting device 45 (FIG. 3), in the form of a hydraulic cylinder.

Parallel to and beside the transverse rod outlet path 4, a displacement device 46 for the transverse rods 22 provided with the slipped-on spacers 30 is provided. This displacement device 46 comprises an endless chain 48, which is wrapped about two chain wheels 47 and has a pusher arm 49 secured to it at each of two opposed locations and moving above the table of the transverse rod outlet path 4. The displacement device 46 is driven at a predetermined rhythm by a drive apparatus 50, and its task is to position each transverse rod 22 deposited on the transverse rod outlet path 4 on the table in such a way that the rod later reaches its intended location on the pallet 15. With the aid of the tilting device 45, the transverse rod outlet path 4 is tilted such that the transverse rod 22 positioned by the displacement device 46 is ejected onto the transverse rod magazine 7.

The longitudinal rod outlet path 5 is mounted in the operating direction (arrow 43) on the straightening, cutting and bending device 2 for the longitudinal rods 23 and is located parallel to the travel path 13, beside and above it. This longitudinal rod outlet path 5 comprises a trough, which is disposed such that it is tiltable, transversely to its longitudinal direction, about two pivot pins 51 on its ends. Lateral recesses 52 allow the insertion robots 9 and 10 to grasp each finished longitudinal rod 23 from the side. A controlled, mechanically actuated tilting device 53, in the form of a hydraulic cylinder, engages the longitudinal rod outlet path 5 laterally.

The lattice girder outlet path 6 adjoins the combination device 3 for producing the lattice girders 24. Each lattice girder 24 has a triangular cross section and comprises an upper chord, two lower chords and at least two rows of lattice rods, as indicated in FIG. 1. The lattice girder outlet path 6 also comprises a lower trough, which is tiltable transversely to its longitudinal direction in two pivot pins 54 provided on its ends with the aid of a tilting device 55. With the aid of the tilting device 55, controlled at a predetermined rhythm, each lattice girder 24 is deposited laterally onto the lattice girder magazine 8. The fastenings of the three tilting devices 45, 53 and 55 on the frame 11 have not been shown in the drawing, for the sake of simplicity.

The transverse rod magazine 7—see FIG. 3, in particular—is mounted laterally on the transverse rod outlet path 4 and is fastened to the frame 11 in a manner not shown. This transverse rod magazine 7 relates to a conveyor apparatus, driven by means of an electric motor 56, which has a relatively large number of closely spaced shelves 57. Each of these trough-like shelves 57 is capable of receiving one transverse rod 22 equipped with spacers 30 that has been ejected from the transverse rod outlet path 4 onto the transverse rod magazine 7. The transverse rod magazine 7 has two pairs of chain wheels 58, over each of which one of two endless conveyor chains 59 are wrapped. The shelves 57 are secured to these conveyor chains 59. The pivot shafts 60 of the chain wheels 58 are disposed in a frame 61 that is inclined obliquely downward in the direction toward the travel path 13. Upon actuation of the electric motor 56, the transverse rods 22 resting on the transverse rod magazine 7 are inserted at its lowermost point into the form 18 at the intended locations, on the pallet 15 that is moving at a predetermined speed past the transverse rod magazine 7 a slight distance beneath it.

The lattice girder magazine 8 is provided between the lattice girder outlet path 6 and the travel path 13 and is secured to the frame 11 with angle brackets 62. This lattice girder magazine 8, which is inclined obliquely downward at an angle of approximately 45° in the direction toward the travel path 13, comprises four parallel carriers 63, in which rows of pawls 64 are disposed in succession, protruding beyond the carriers 63 with their pawl protrusions. In the transverse direction, four pawls 64 at a time, located at the same level, are connected to one another by rotatably supported crossbars 65, the ends of which are threaded at one side into an electrically controlled mechanical actuating device 66, which is located parallel to the carriers 63. Each lattice girder 24 produced in the combination device 3 and ejected onto the lattice girder outlet path 6 is ejected by being tipped out onto the top of the lattice girder magazine 8, where it remains, retained by the uppermost row of four pawls 64. Before the next lattice girder 24 is ejected, the actuating device 66 starts up, releasing the uppermost row of four pawls 64, so that the lattice girder 24 slides downward on the carriers 63 in the direction of the travel path 13, until the next row of four pawls stops it. In this way, the lattice girders 24 are passed on downward, where the lowermost lattice girder 24 is then grasped by the insertion robots 9 and 10.

The two identically embodied insertion robots 9 and 10 are disposed above the travel path 13 in two rails 67 provided parallel to the travel path 13 such that they are displaceable in the longitudinal direction of the travel path 13. To this end, the two insertion robots 9 and 10 are provided with lateral rollers 68. Each insertion robot 9 and 10 has a pivoting arm 69, comprising an upper arm 70 and a lower arm 71, which is pivotably connected to the upper arm and is movable in a plane at right angles to the travel path 13.

Mounted on the free end of the pivoting arm 69 of the two insertion robots 9, 10 is a tong-like double gripper 72 with jaws the opening of which is suitable for grasping a round wire of a lattice girder 24 or longitudinal rod 23. The pivoting range 73 of the two pivoting arms 69 extends from the longitudinal rod outlet path 5 as far as the lowermost point of the lattice girder magazine 8. Because of the displaceability of the two insertion robots 9 and 10, each lattice girder 24 and each longitudinal rod 23 of arbitrary length can be placed on the pallet 15, as it travels below and past the insertion robots 9 and 10 at a predetermined speed, precisely at the intended point inside the form 18, on top of the transverse rods 22 already located there.

The function of the apparatus is as follows: The pallet 15 is introduced into the frame 11 at a predetermined speed on the travel path 13; this speed may be constant, or it may vary as the pallet travels through the frame. While the pallet 15 travels through the frame below the transverse rod magazine 7, the transverse rods 22 prepared by the straightening and cutting device 1 and positioned by the displacement device 46 and located transverse to the travel path 13 are inserted in succession into the form 18 at a predetermined rhythm, these transverse rods having already been provided with the spacers 30 at appropriate intervals. As soon as the pallet 15, in its continuing travel, enters the region underneath the two insertion robots 9 and 10, these robots, with the double grippers 72 of their pivoting arms 69, grasp the lattice girders 24 and the longitudinal rods 23 that have been prepared by the combination device 3 and the straightening, cutting and bending device 2 and that are already ready on the lowermost row of four pawls 64 of the lattice girder magazine 8 or on the longitudinal rod outlet path 5 parallel to the travel path 13. Under suitable control, the two insertion robots 9 and 10 place the lattice girders 24 and the longitudinal rods 23 at the points intended for them, on top of the transverse rods 22 that are already there. Once this operation is completed, the form 18 contains the entire reinforcement, whereupon the pallet 15 leaves the frame 11 and is moved to where the concrete is poured into the form 18; the concrete then undergoes compacting by being shaken and finally is given a resting period so it can set.

Not only can all the parts of the apparatus be controlled such that the transverse rods 22 and the longitudinal rods 23 are deposited into the form 18 equidistantly—as shown in the drawing; it is moreover readily possible, without further effort, to insert the reinforcement at different intervals, which are matched precisely to the static requirements of the plate.

As FIG. 1 shows, the parts of the apparatus that serve to prepare and insert the transverse rods 22—that is, the straightening and cutting device 1 for the transverse rods 22, the slip-on device 29 for the spacers 30, the transverse rod outlet path 4 with its displacement device 46, and the transverse rod magazine 7—are disposed on a frame 74 (shown in broken lines), which is disposed such that it is displaceable on the frame 11 parallel to the travel path 13 by a suitable drive means (not shown). To this end, the frame 74 may have rollers (not shown), which run in rails (not shown) of the frame 11.

We claim:

1. An apparatus for producing reinforcements, intended for construction purposes, of reinforced concrete plates for prefabricated ceilings, using forms, serving to receive the reinforcements as well as the poured concrete, that can be set up on pallets that are movable along a travel path, having a straightening and cutting device for preparing the transverse rods, a straightening, cutting and bending device for the longitudinal rods, and a combination device for preparing the lattice girder, which devices have outlet paths for the transverse rods, longitudinal rods and lattice girders and are supplied with round wires and bands of structural steel, wound into rings, characterized in that, (a) the transverse rod outlet path (4) is located above the travel path and at right angles to it, (b) the longitudinal rod outlet path (5) and the lattice girder outlet path (6) are located opposite each other and parallel to, on opposite sides of and above the travel path (13), (c) a lattice girder magazine (8) is provided between the lattice girder outlet path (6) and the travel path (13), and (d) two insertion robots (9 and 10) are disposed between the lattice girder magazine (6) and the longitudinal rod outlet path (5).

2. An apparatus as defined by claim 1, characterized in that a displacement device (46) is provided on the transverse rod outlet path (4).

3. An apparatus as defined by claim 1, characterized in that the transverse rod outlet path (4), the longitudinal rod outlet path (5) and the lattice girder outlet path (6) are disposed such that they are tiltable transversely to their longitudinal direction.

4. An apparatus as defined by claim 1, characterized in that a mechanically actuated tilting device (45, 53, 55) engages the transverse rod outlet path (4), the longitudinal rod outlet path (5) and the lattice girder outlet path (6).

5. An apparatus as defined by claim 1, characterized in that a transverse rod magazine (7) is mounted laterally on the transverse rod outlet path (4).

6. An apparatus as defined by claim 5, characterized in that serving as the transverse rod magazine (7) is a conveyor apparatus, which has shelves (57) for receiving the transverse rods (22) that have been provided with the spacers (30).

7. An apparatus as defined by claim 1, characterized in that between the straightening and cutting device (1) for the transverse rods (22) and the transverse rod outlet path (4), a slip-on device (29) for spacers (30) is provided.

8. An apparatus as defined by claim 7, characterized in that the slip-on device (29) has a mechanically actuated ram (36) and is connected to a shaker conveyor (31).

9. An apparatus as defined by claim 1, characterized in that the straightening, cutting and bending device (2) for the longitudinal rods (23), along with its longitudinal rod outlet path (5), and the combination device (3) for the lattice girders (24), along with the lattice girder outlet path (6), are mounted above the travel path (13).

10. An apparatus as defined by claim 1, characterized in that the insertion robots (9 and 10) are provided above the travel path (13).

11. An apparatus as defined by claim 1, characterized in that the insertion robots (9 and 10) have pivoting arms (69), which are movable in planes at right angles to the travel path (13).

12. An apparatus as defined by claim 11, characterized in that a tong-like double gripper (72) is mounted on the free end of the pivoting arm (69).

13. An apparatus as defined by claim 1, characterized in that the two insertion robots (9, 10) are disposed such that they are displaceable in the longitudinal direction of the travel path (13).

14. An apparatus as defined by claim 1, characterized in that the lattice girder magazine (8) has mechanically actuated pawls (64).

15. An apparatus as defined by claim 1, characterized in that the straightening and cutting device for the transverse rods (22), the slip-on device (29), the transverse rod outlet path (4), the displacement device (46) and the transverse rod magazine (7) are disposed such that they are displaceable in common, parallel to the travel track (13), in the frame (11).

* * * * *